US012661571B1

(12) United States Patent
Baker

(10) Patent No.: US 12,661,571 B1
(45) Date of Patent: Jun. 23, 2026

(54) GLOVE

(71) Applicant: Scott Baker, Sherman Oaks, CA (US)

(72) Inventor: Scott Baker, Sherman Oaks, CA (US)

( * ) Notice: Subject to any disclaimer, the term of this patent is extended or adjusted under 35 U.S.C. 154(b) by 252 days.

(21) Appl. No.: 18/116,261

(22) Filed: Mar. 1, 2023

Related U.S. Application Data

(63) Continuation-in-part of application No. 15/853,255, filed on Dec. 22, 2017, now Pat. No. 11,865,431.

(51) Int. Cl.
*A63B 71/14* (2006.01)
*A41D 19/00* (2006.01)

(52) U.S. Cl.
CPC ..... *A63B 71/145* (2013.01); *A41D 19/0017* (2013.01); *A41D 19/0048* (2013.01)

(58) Field of Classification Search
CPC ..... A41D 19/0013; A41D 19/0017; A41D 19/0048; A41D 19/01582; A41D 19/01558; A63B 71/145
See application file for complete search history.

(56) References Cited

U.S. PATENT DOCUMENTS 3,903,546 A * 9/1975 Rhee ..... A63B 71/145 2/18
4,411,024 A * 10/1983 Hayes ..... A63B 71/145 2/161.1
4,417,359 A * 11/1983 Johnson ..... A63B 71/145 D29/117.1
4,603,439 A * 8/1986 Golomb ..... A63B 71/145 2/18
5,575,008 A * 11/1996 McBride ..... A41D 19/01523 2/161.1
6,119,267 A * 9/2000 Pozzi ..... A41D 13/088 2/161.1
6,691,315 B1 * 2/2004 Clarke ..... A63B 71/145 2/18
8,646,113 B2 * 2/2014 Clement ..... A41F 1/06 2/161.1
9,380,820 B1 * 7/2016 Griego ..... A63B 21/00
9,545,126 B2 * 1/2017 Bisaillon ..... A41D 19/01523
10,004,975 B2 * 6/2018 Clement ..... A63B 71/145
2011/0277205 A1 * 11/2011 Cuadrado ..... A41D 19/01523 2/18
2013/0000006 A1 * 1/2013 Norton ..... A41F 1/06 2/16
2016/0367881 A1 * 12/2016 Le ..... A41F 1/06
2017/0001097 A1 * 1/2017 Ferrer ..... A41D 19/01523

* cited by examiner

*Primary Examiner* — F Griffin Hall

(57) ABSTRACT

A glove comprising an upper surface, a lower surface, finger sheaths, and a thumb sheath. The glove configured for ease of entry as well as to prevent the finger sheaths from moving into a linear extended position, while allowing the finger sheaths to be in a curved position or a clenched position.

7 Claims, 15 Drawing Sheets

FIG. 18
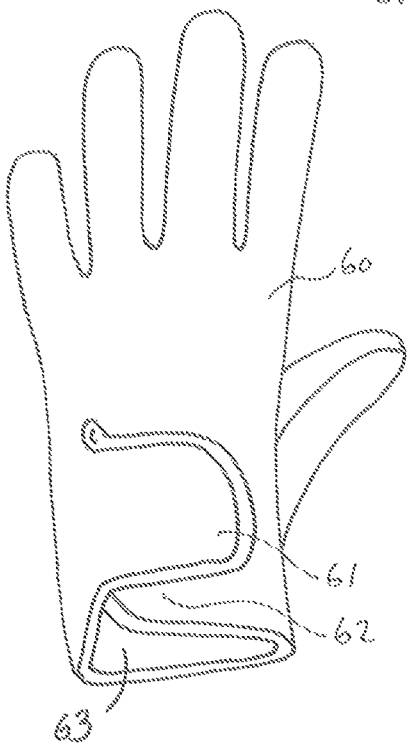
FIG. 19
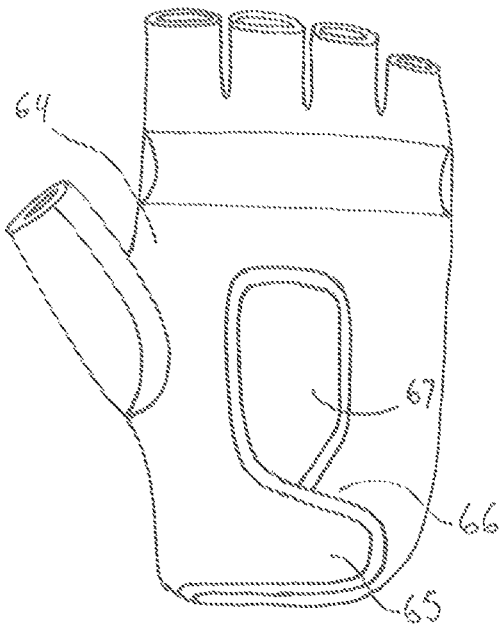
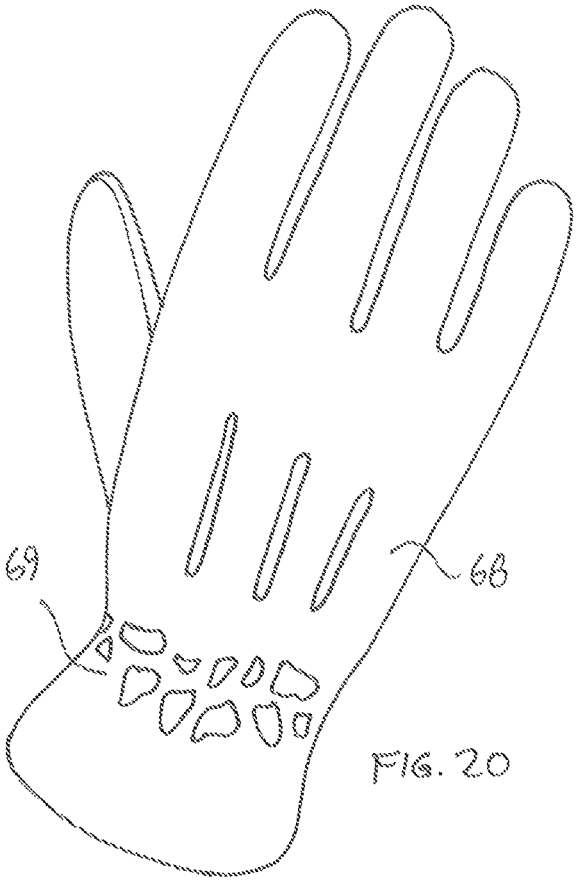
FIG. 20
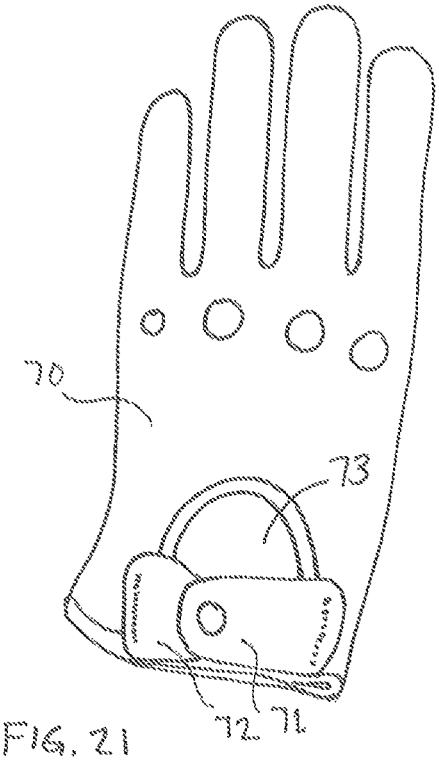
FIG. 21

GLOVE

CROSS-REFERENCE TO RELATED APPLICATIONS

This application claims the benefit of U.S. patent application Ser. No. 15/853,255 filed Dec. 22, 2017.

FIELD AND BACKGROUND OF THE INVENTION

This invention relates to a glove. More particularly, the invention is for a glove which may be used by an athlete, and wherein the glove is constructed so that hand movement within the glove is somewhat limited or restricted. In one form, the glove may be used by a person practicing in the fields of boxing or mixed martial arts (MMA), although the invention is not limited thereto.

Fighting has long been a popular sport. For most of the last 100 years or so boxing has been a dominant force in attracting viewers and thus revenue. As the sport has evolved with stronger athletes, athlete protection has become more and more advanced. The boxing glove of 50 years ago is more like a mitten when compared to the boxing gloves available today. Not only has the outside of the glove changed, but the inside mechanics have also evolved to better protect the fighter's hands.

Over about the last 20 years and certainly in the last 10 years, Mixed Martial Arts (MMA) has become one of the top fighting sports in attracting viewers and revenues away from boxing. While the rules have developed significantly as with anything new, the protection for the fighters has been lagging behind in one particular arena.

The very nature of "mixed" martial arts involves a mix comprising predominantly boxing techniques and grappling techniques. Grappling techniques require that a fighter's hands, specifically his fingers, be free from the type of confinement a boxing glove incorporates, such that the fighter's fingers are exposed thereby allowing fighters to use the dexterity and mobility of their fingers in order to grab an opponent in a variety of ways in an effort to submit them and win the contest.

One of the safety issues that has long existed in MMA specifically as a result of the "open fingered glove" designs is "eye pokes". An eye poke can occur at any time and with no malicious intent attached to it. When a fighter is moving closer and perhaps starts to throw a punch (with a clenched fist), but suddenly has to adapt to a movement from the opponent by changing that clenched first into an open palmed block of some sort, the fingertip on an extended or straightened hand can drive directly into the opponent's eye causing at the very minimum discomfort and momentary blurred vision, but also potentially permanent eye damage.

There has long been a need for a glove design that offers padding similar to a boxing glove while allowing finger movement to grab, and at the same time restricting the ability for a finger to poke an opponent's eyeball, or other vulnerable body part.

SUMMARY OF THE INVENTION

In one aspect of the invention, there is provided a glove preferably for use in Mixed Martial Arts (MMA) for protecting a fighter's hands while allowing that fighter to use his fingers and also protecting the fighter's opponents from an accidental fingertip eye poke or other injury.

Current MMA gloves are produced in a few sizes which by that very nature do not afford a tight fit surrounding the fingers themselves. In fact, many glove designs have a pliable material utilized for the sides of the finger sheaths while the top and bottom portions of the finger sheath and glove is typically a stronger material such as leather. MMA gloves allow for the thumb to be fully or partially exposed and the fingers to have one or two knuckles per finger exposed. The pliable material on the sides of finger sheaths allows for even more movement of the finger inside the actual finger sheath area of the glove.

The built-in mobility combined with the added movement due to the material choice in a conventional MMA glove allows for a fighter's fingers to be straightened out completely and risk the occurrence of an eye poke to an opponent.

The current invention is directed toward resolving this safety issue while also offering easier entry into the glove, a better fit, and better mobility for the fighter.

When a user's hand is in a naturally relaxed state, there is a curve to the hand. The palm is cupped and the fingers are arched. This relaxed position is the maximum extended/straightened movement the current invention allows the finger sheaths while also allowing the user to fully clench their hand into a fist.

Currently available gloves such as for work or driving or winter weather in general and for MMA are constructed with a back surface and a palm surface sew together flat with finger sheaths attached and also flat, when this glove is laid on a table or other flat surface the glove lays flat.

MMA gloves also have knuckle padding on the back surface to protect the knuckles, this padding is manufactured in a flat position and attached onto the glove in a flat position.

This design and construction means the default position of current MMA gloves is flat or linearly straight, therefore when a user clenches their hand into a first or any arc pulling away from being flat they are pulling/stretching the material into a an arced position leading to a clenched first which is a rolled position, from flat to rolled which creates tension in the entire material and padding which requires a certain amount of the user's focus to maintain the glove in a position pulled from the glove's default flat position and a certain amount of the user's energy to resist the glove's constant pulling back to its default straight or flat position.

The method used for constructing the current invention has the finger sheaths built in an arched position, and the knuckle padding for the finger sheaths is also built in an arched position. This means the finger sheaths by themselves when not attached to the glove rest in an arched position similar to or more arched than a hand in a natural resting position. The knuckle padding when not attached to the glove rests in an arched position similar or more arched than a hand in a natural resting position. There is also knuckle padding attached to the back portion of the glove. The back of a hand in a natural resting position has an arc from the index finger side of the hand to the pinky finger side of the hand with the highest point of the arc being at the middle finger area of the back of the hand. The knuckle padding that is attached to the back of the glove to protect the first knuckles of the fingers is also constructed in a manner that creates a natural arc position similar to a hand in a natural resting position when not attached to the glove.

Furthermore, the palm portion of the current invention begins at the wrist/entry area and extends straight to the fingertip end of each finger sheath, this method of design and construction further supports the arched position of each finger sheath which matches the natural resting position of a hand while offering additional linear restriction to the finger sheaths. This design and construction method means the default position of the glove is in an arched position and therefore no focus or energy is required from the user to resist a constant pulling back to a default straight or flat position as found with current MMA gloves, this allows the user greater physical and mental freedom while in the midst of a potentially hazardous situation.

The design and position of the entry portion of the current invention and the method by which the glove opens allows for a user to maintain a more natural hand position while entering the glove.

Additionally, current MMA gloves use a securement strap that attaches at one side of the glove entry opening and wraps around the glove at the wrist area to then secure to itself, this does not achieve a tightening of the size of the entry opening as the strap pulls the entire glove around the wrist chasing itself but never fully catching itself and requiring athletic tape to be used around the wrist area to further secure the glove to the user, or just being used not completely sufficiently tight.

The current invention has a securement strap that is positioned such that the entry end of the glove is reduced in size prior to securement due to the securement strap being attached at one side of the glove entry opening and then weaving through the other side of the glove entry opening and folding back to the attachment point side of the entry opening allowing the entry opening to be pulled smaller and then secured with a hook and loop material.

BRIEF DESCRIPTION OF THE DRAWINGS

FIG. 18 Shown in top view is a typical glove.

FIG. 19 Shown in top view is a typical fighting glove.

FIG. 20 Shown in top view is a typical winter glove.

FIG. 21 Shown in top view is a typical driving glove.

DETAILED DESCRIPTION OF THE DRAWINGS

Figure 1:
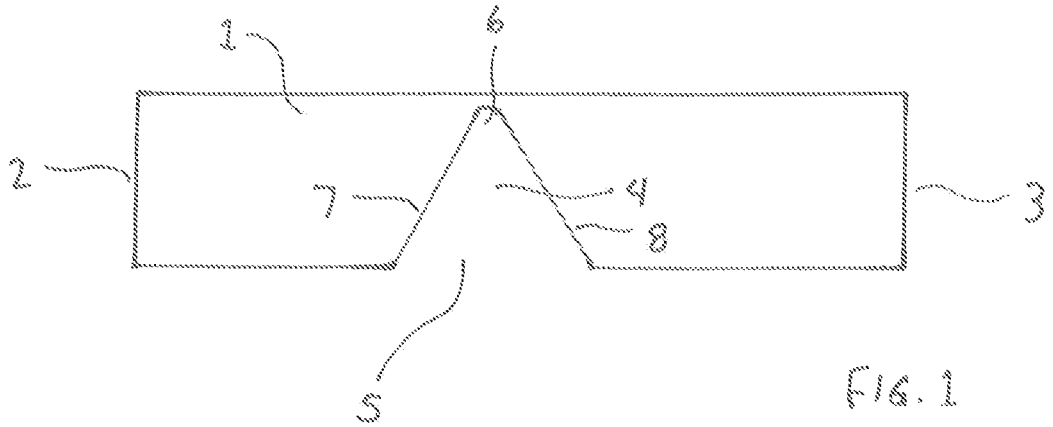
FIG. 1 Shown in side view is a finger sheath with an inverted "V" cutout.

FIG. 1 Shown in side view is a finger sheath 1 with an inverted "V" cutout 4. The finger sheath 1 shown flat with the fingertip end of the finger sheath 2 shown in the 9 o'clock position left and the finger sheath to back portion attachment end 3 shown in the 3 o'clock position. The inverted "V" cutout 4 having an open end 5 shown in the 6 o'clock position, a closed end 6 shown in the 12 o'clock position. The inverted "V" cutout also having a fingertip side 7, and a back portion attachment side 8.

Figure 2:
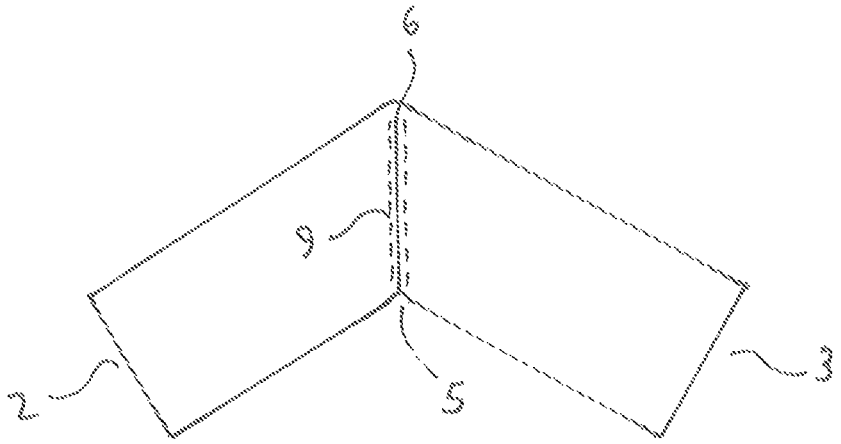
FIG. 2 Shown in side view is a finger sheath positioned into an arc closing the inverted "V" cutout area.

FIG. 2 Shown in side view is a finger sheath 1 positioned into an arc position closing the inverted "V" cutout area 4 bringing the fingertip side of the inverted "V" 7 and a back portion attachment side of the inverted "V" 8 together for permanent attachment at the attachment point 9.

Figure 3:
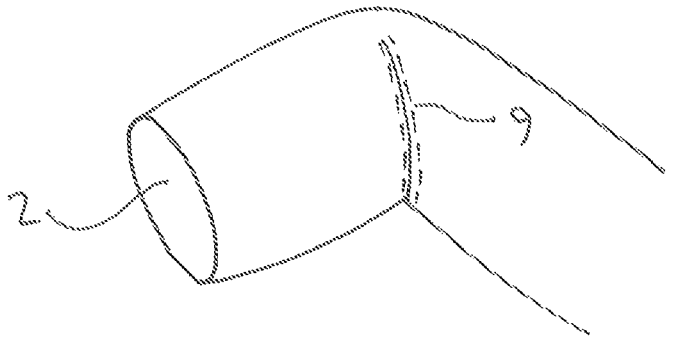
FIG. 3 Shown in 14 side view is a finger sheath.

FIG. 3 Shown in 14 side view is the finger sheath 1 exhibiting the permanent restrictive nature of the construction. This configuration removes the ability for the finger sheath to ever straighten thus not allowing a user of the glove to ever straighten their finger.

Figure 4:
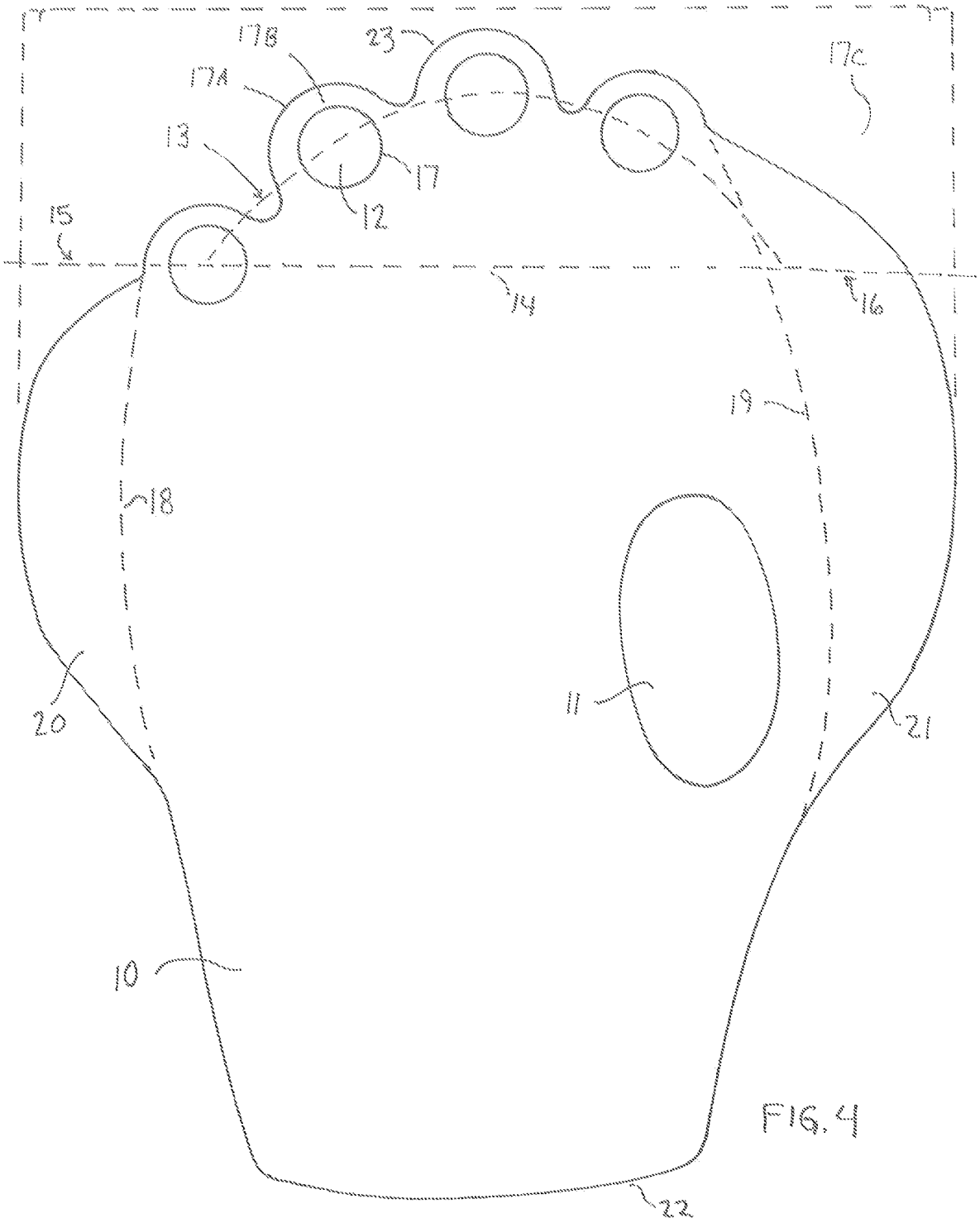
FIG. 4 Shown in top view is the palm portion of the glove.

FIG. 4 Shown in bottom view is the palm portion of the glove 10, having an entry end 22 and a finger sheath fingertip end 23, and a thumb sheath attachment hole 11.

The palm portion 10 having a horizontal dotted line 14 with a 9 o'clock end 15 and a 3 o'clock end 16 and with an arced dotted line 13 attached. The horizontal dotted line 14 and arced dotted line 13 are similar to the Sun coming up over the horizon.

A plurality of small circles 17 are drawn centered on the arced dotted line 13. Larger half circles 17A are drawn around the smaller circles 17 one the fingertip side of the arced dotted line 13.

The fingertip end of the palm portion 23 has excess material 17C (indicated by a dotted line) is removed, then the material within the small circles 17 is removed now the small circles 17 become the finger sheath holes 12, this allows the fold over material 17B to become usable. Once the finger sheath fingertip end 2 (see FIG. 3) is placed through the finger sheath holes 12 the fold over material 17B is folded down to touch, and then be attached to the finger sheath 1.

Palm portion flap 21 and palm portion flap 20 are utilized to enclose the distance between the arc of the finger sheath 1 and the palm portion 10, the palm portion 10 which is configured in a flat position from the entry end 22 of the glove directly to the fingertip end 2 of the finger sheath 1. The palm portion flaps 20 & 21 are folded along dotted line 19 for palm portion flap 21 and along dotted line 18 for palm portion flap 20.

Figure 5:
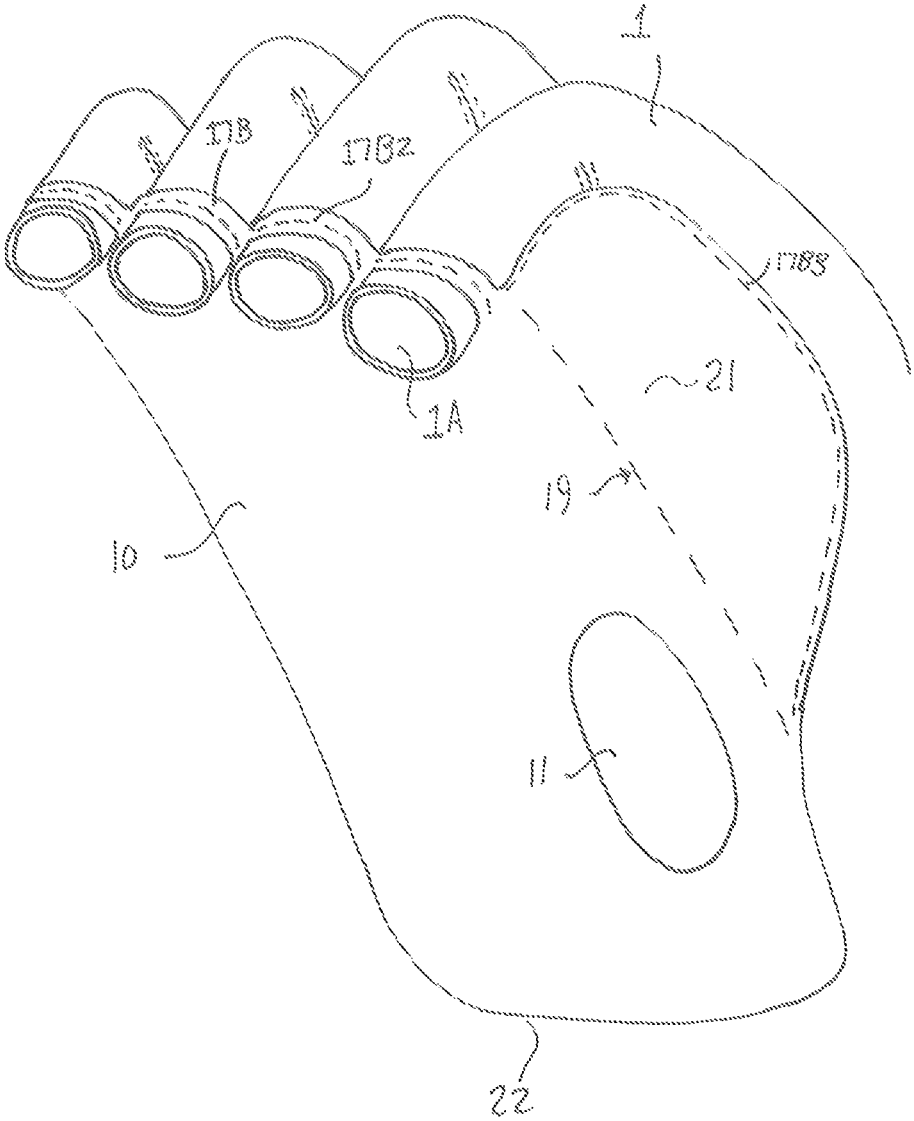
FIG. 5 Shown in % side bottom view is the glove detailing the palm portion as it connects to finger sheaths.

FIG. 5 Shown in /3;4 side bottom view is the glove detailing the palm portion 10 as it connects to fingertip end 1A of the finger sheath 1. The fold over material 17B (also see FIG. 4) is shown folded down onto the finger sheath and then attached with stitching 17B2 across the top and sides of the finger sheath in this embodiment. The palm portion flap 21 is detailed here having folded over dotted line 19 to engage the finger sheath 1 enclosing the gap between the finger sheath 1 arc shape and the flat surface of the palm portion 10. The palm portion flap is stitched 17B3 to the finger sheath 1. The finger sheath fingertip opening 1A of each finger sheath 1 is shown.

Figure 6:
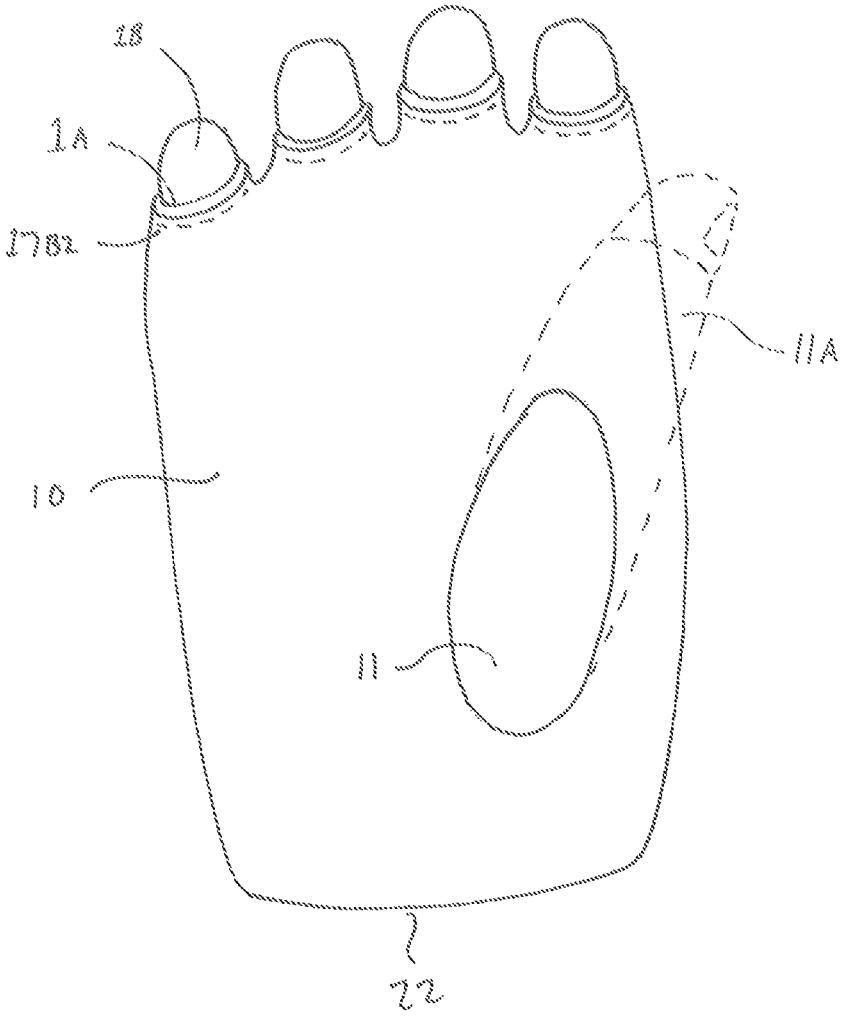
FIG. 6 Shown in bottom view is the palm portion of the glove.

FIG. 6 Shown in bottom view is the palm portion 10 of the glove. The thumb sheath is shown in ghost form with dotted line 11A to allow for clear view of palm portion 10. Fingertips of a user 1B are shown within the finger sheath fingertip end 1A. The continued stitching 17B2 which attaches the palm portion 10 to the bottom and sides of the finger sheaths 1 is also detailed.

Figure 7:
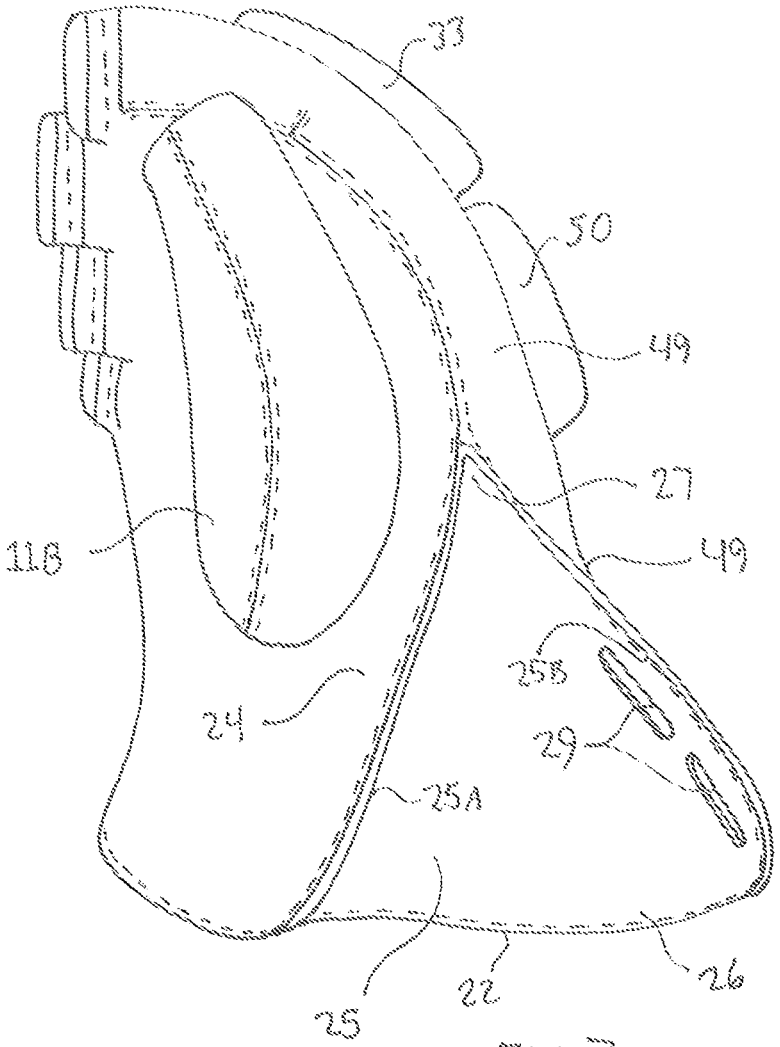
FIG. 7 Shown in side view is the medial side of the glove detailing the additional entry opening space fully expanded.
Figure 10:
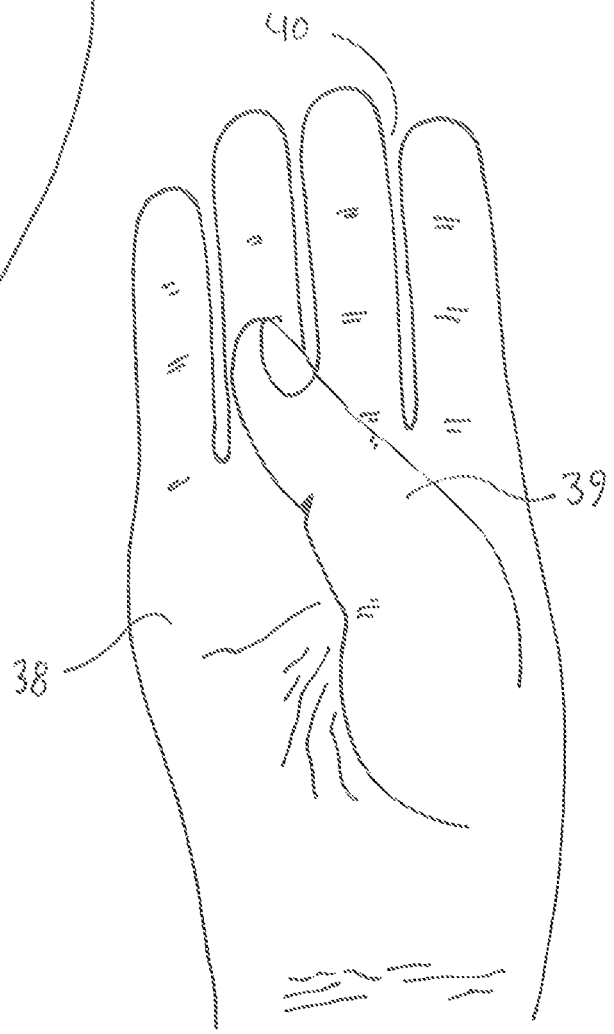
FIG. 10 Shown in bottom view is a hand the typical position required to enter a glove.

FIG. 7 Shown in side view is the glove detailing the medial side of the glove 24 and the inverted "V" shaped additional entry opening space 25 in a fully expanded position creating additional access by way of a larger entry path into the glove for the user and also being configured to be intuitive in shape to the shape of a hand in a natural resting position not requiring the hand to compress as shown in FIG. 10. The closed end of the inverted "V" 27 positioned at the mid point of the thumb sheath attachment hole (see FIG. 6 #11), the open end of the inverted "V" 26 positioned at the entry end of the glove 22.

The palm portion side edge of the inverted "V" 25A and the back portion side edge of the inverted "V" 25B are also detailed.

The back portion 49 of the glove, the securement strap slots 29, the thumb sheath 11B, the finger sheath knuckle padding 33, and back portion knuckle padding 50 are also detailed.

This feature transforms what would normally be the narrowest part of the glove, the wrist area, into the widest part of the glove allowing the widest part of the hand to enter the glove in a position that is a natural resting position of the hand with no requirement to bring the fingers together or to position the thumb over the palm of the hand.

Figure 7A:
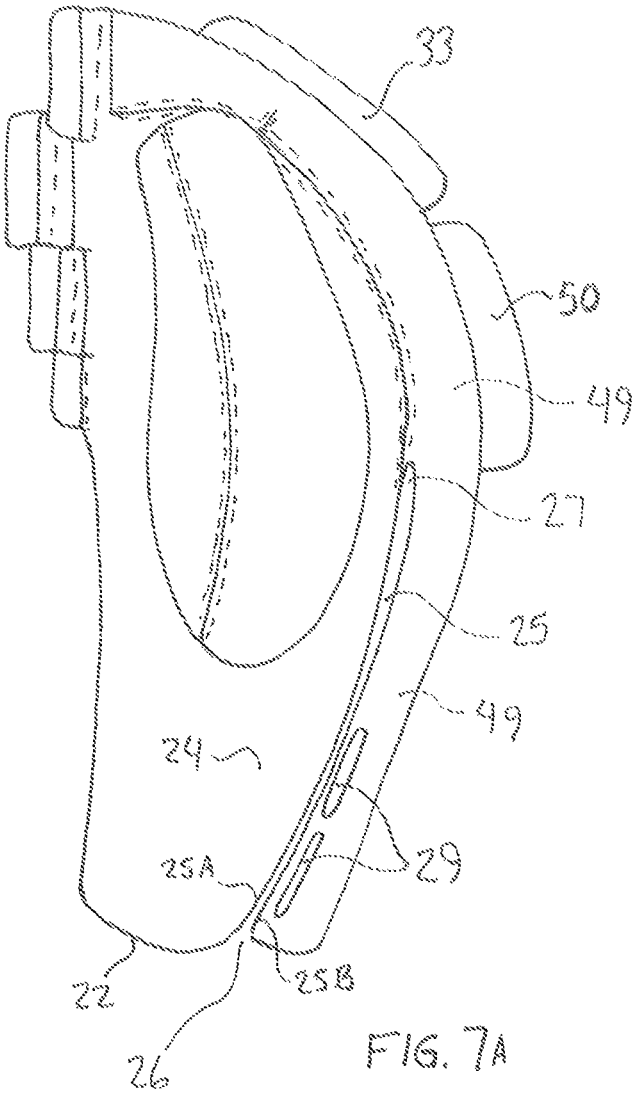
FIG. 7A Shown in medial side view is the glove detailing the additional entry opening space fully closed.

FIG. 7A Shown in side view is the glove detailing the medial side of the glove 24, the inverted "V" shaped additional entry opening space 25 in a fully closed position with the back portion side edge of the inverted "V" 25B and the medial side edge of the inverted "V" 25A almost touching, shrinking the size of the open end of the inverted "V" 26.

Figure 8:
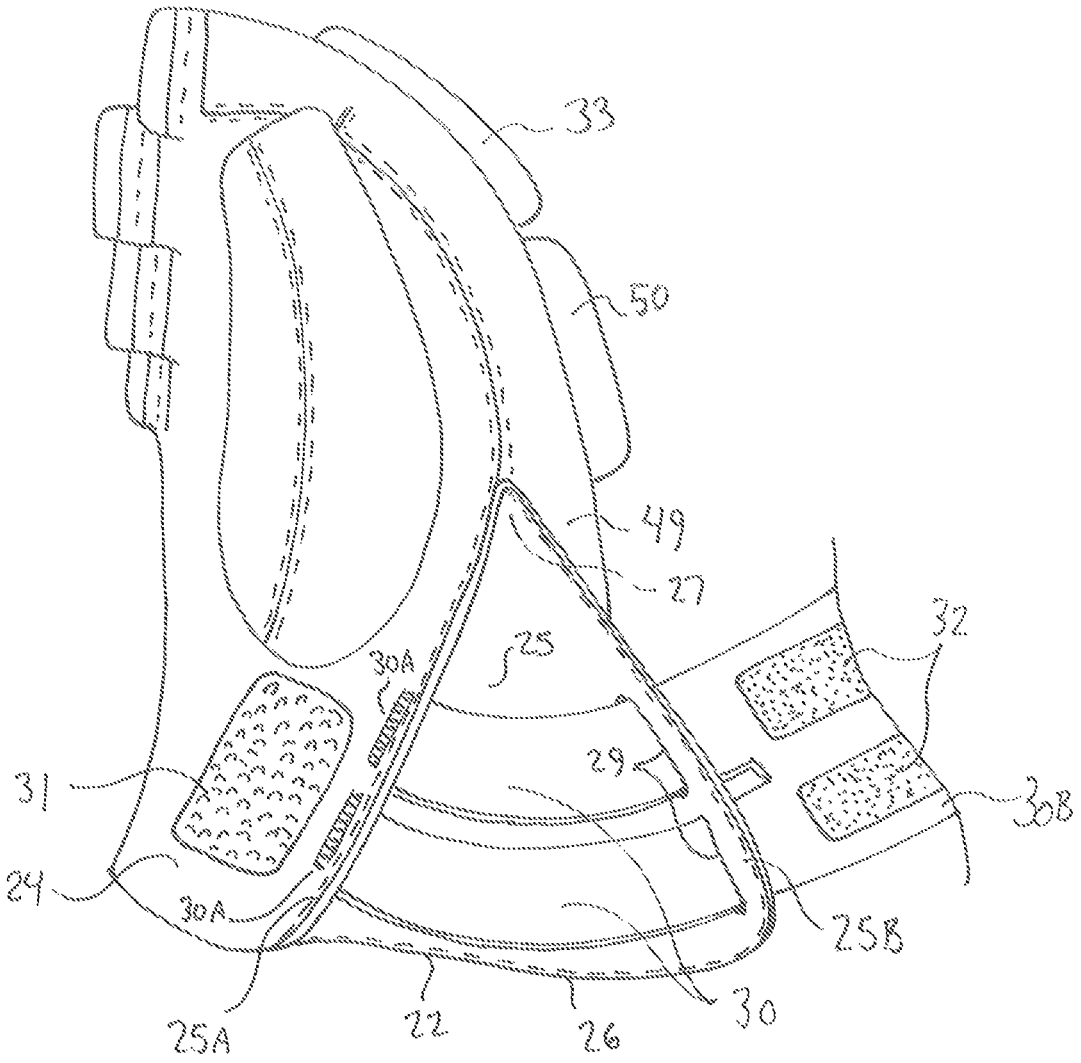
FIG. 8 Shown in medial side view is the glove detailing the additional entry opening space fully expanded and with securement strap attached.

FIG. 8 Shown in side view is the glove detailing the medial side of the glove 24 further detailing the inverted "V" shaped additional entry opening space 25 fully expanded, the securement strap 30 is permanently attached to the medial side of the inverted "V" 25A at the securement strap attachment point 30A, the other end of the securement strap 30B is positioned through the securement strap slots 29 located on the back portion 49 of the glove. The securement strap 30 containing the male portion of a hook and loop material 32 and the medial side of the glove 24 containing a female portion of a hook and loop material 31. Finger sheath knuckle padding 33 and back portion knuckle padding 50 are also detailed.

Figure 9:
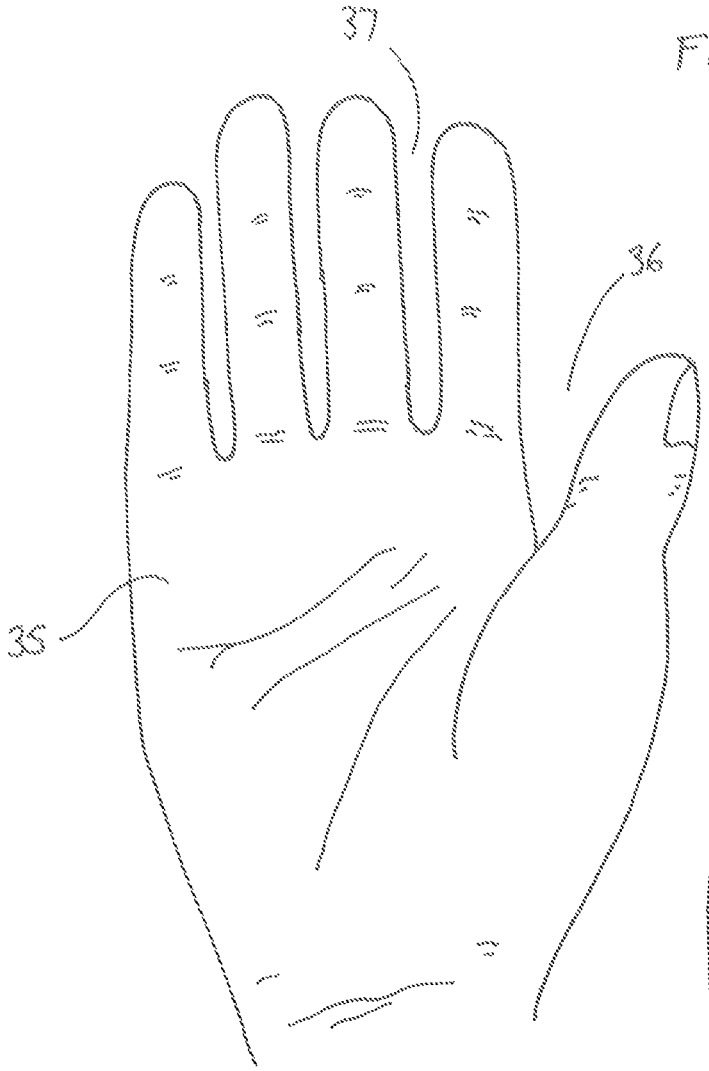
FIG. 9 Shown in bottom view is a hand in a natural resting position.

FIG. 9 Shown in bottom view is a hand in a natural resting position 35, and further detailing the natural resting position space between the thumb and index finger 36, and the natural resting position space between fingers 37. When turning this resting position hand 90 degrees counter-clockwise the natural arc of the hand/fingers comes into view. The feature described in FIGS. 7&8 above allow the user's hand to enter the glove in the natural position detailed in this figure, once initial entrance of the glove has occurred the natural arc of the fingers of the user follow the arc of the finger sheaths.

FIG. 10 Shown in bottom view is a hand in the compressed position 38 required to enter a glove, and further detailing the thumb position 39 being moved over the center of the palm of a hand, also showing the reduced space between the fingers 40. This compressed position is required due to current glove designs. FIGS. 18, 19, & 21 show typical gloves having an area for additional space being on the back portion or the palm portion of the glove, this is common placement in the industry and counter intuitive to the shape of the hand.

Figure 11:
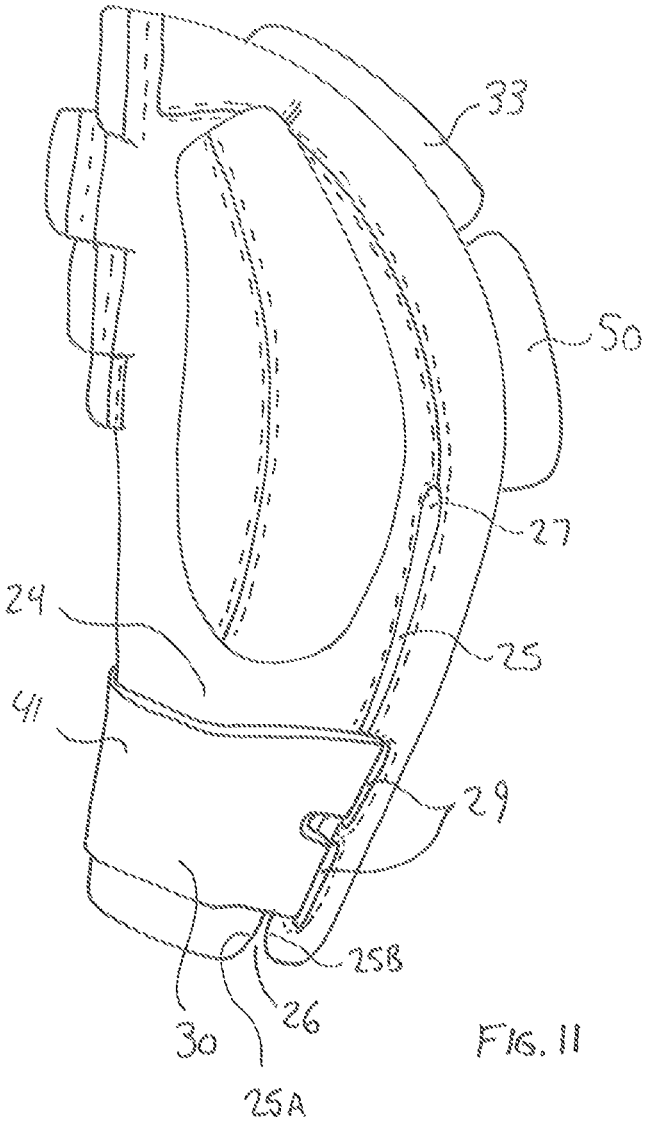
FIG. 11 Shown in medial side view is the glove detailing the additional entry opening space fully closed by way of the securement strap.

FIG. 11 Shown in side view is the glove detailing the medial side of the glove 24 and further detailing the inverted "V" shaped additional entry opening space 25 fully closed by way of the securement strap 30. The palm side 25A and the back side 25B of the open end 26 of the inverted "V" shape 25 (see FIG. 8) are significantly close to touching.

Because the strap is attached to one side of the inverted "V" and passed through the other side of the inverted "V", when the user pulls the strap back to the palm portion side of the glove it keeps the palm portion side of the glove from moving while it pulls the back portion of the inverted "V" towards the palm portion side of the glove bringing the two sides of the inverted "V" together closing the inverted "V", similar to cinching a belt tight using the leverage against the buckle the belt passes through, and then securing the belt with the pin through a chosen hole, the glove strap securing the entry opening size by engagement of the two hook and loop components. (further detailed in FIG. 23)

Figure 12:
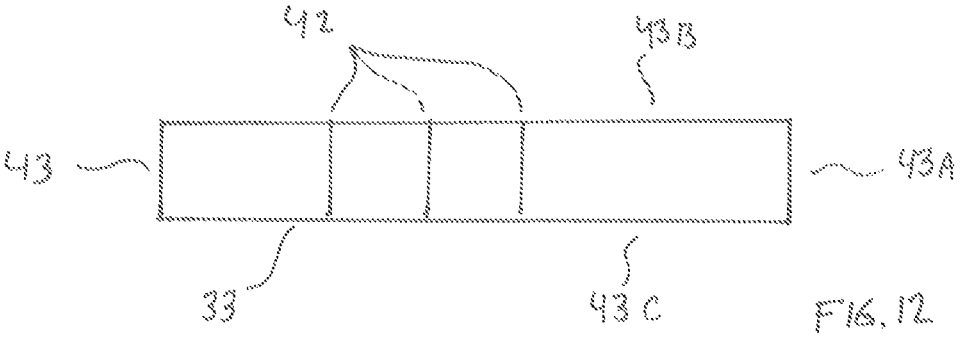
FIG. 12 Shown in side view is finger sheath knuckle padding with cut marks detailed.

FIG. 12 Shown in side view is the finger sheath knuckle padding 33 with the fingertip end of the padding 43 shown at the 9 o'clock position, the back attachment end of the padding 43A shown at the 3 o'clock position, the cuts 42 starting shown at 12 o'clock position edge 43B and almost touching the shown at 6 o'clock position edge 43C.

Figure 13:
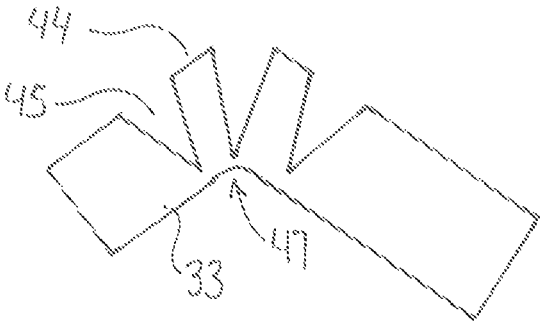
FIG. 13 Shown in side view is finger sheath knuckle padding positioned in an arc with the cuts stretched open.

FIG. 13 Shown in side view is the finger sheath knuckle padding 33 positioned in an arc shape 47 with the cuts 42 stretched into an open position 45.

Figure 14:
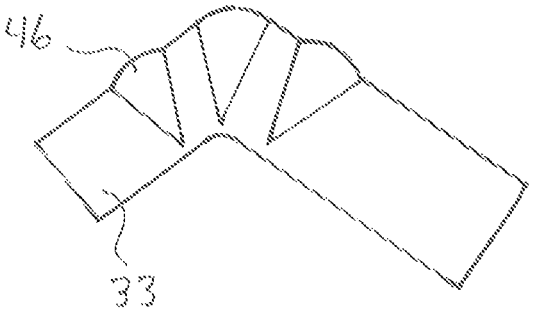
FIG. 14 Shown in side view is finger sheath knuckle padding positioned in an arc with the cuts stretched open and filled with additional padding to permanently maintain the arc shape.

FIG. 14 Shown in side view is the finger sheath knuckle padding 33 positioned in an arc 47 with the cuts 42 stretched into an open position 45 and filled with additional padding 46 to permanently maintain the arc shape 47 as the natural default position and being similar to the arc of the finger sheath and similar to the natural arc of a finger at rest.

Figure 15:
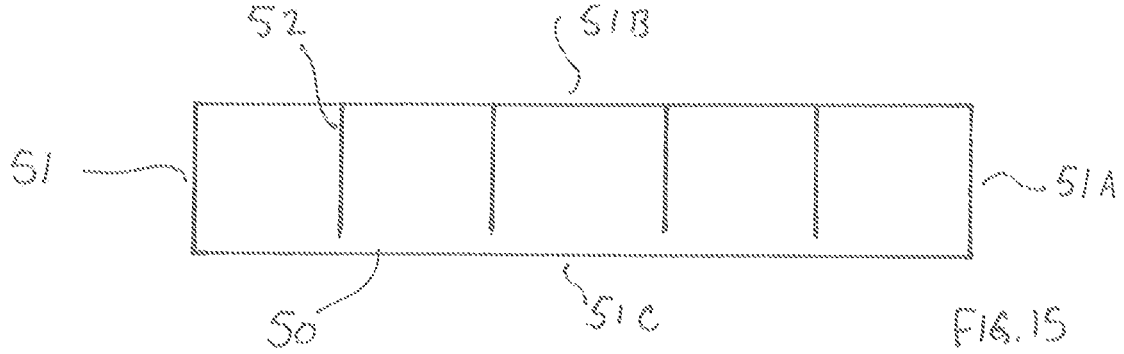
FIG. 15 Shown in side view is the main knuckle padding for the back portion of the glove with cut marks indicated.

FIG. 15 Shown in side view is the back portion knuckle padding 50 for the back portion of the glove, the medial side of the padding shown at the 9 o'clock position 51, the lateral side shown at 3 o'clock position 51A, the cuts 52 start shown at 12 o'clock position edge 51B and end almost at the 6 o'clock position edge 51C.

Figure 16:
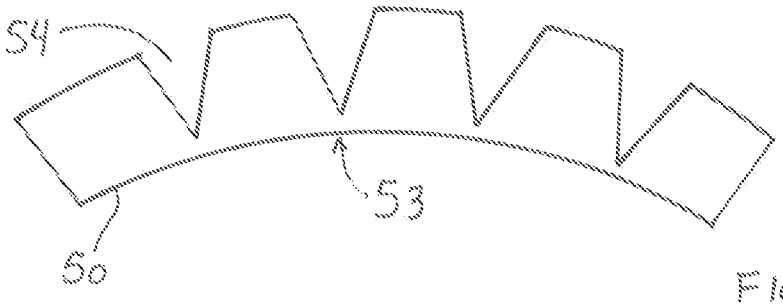
FIG. 16 Shown in side view is the main knuckle padding for the back portion of the glove positioned in an arc with the cuts stretched open.

FIG. 16 Shown in side view is the back portion knuckle padding 50 for the back portion of the glove positioned in an arc 53 with the cuts 52 stretched open 54.

Figure 17:
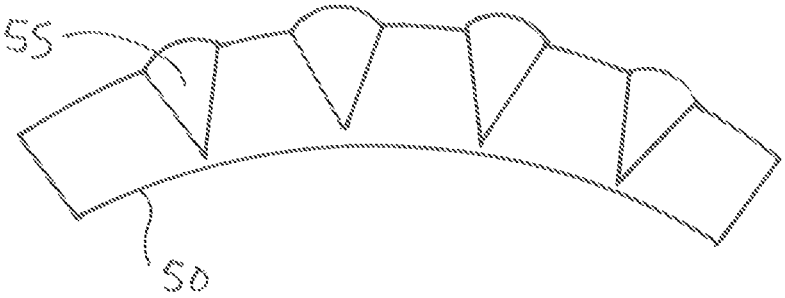
FIG. 17 Shown in side view is main knuckle padding for the back portion of the glove positioned in an arc with the cuts stretched open and filled with additional padding to permanently maintain the arc shape.

FIG. 17 Shown in side view is the back portion knuckle padding 50 for the back portion of the glove positioned in an arc 53 with the cuts 52 stretched open and filled with additional padding 55 to permanently maintain the arc 53 shape as the natural default position, and being similar to the arc of the back of a hand from the index finger to the pinky finger when at rest.

FIG. 18 Shown in top view is a typical work glove 60, having a pull over flap 61 with a hook and loop material, an under flap 62 with a hook and loop material, and an entry area 63. This glove offers no way to stop the under flap 62 from moving to the right as the over flap 61 is pulled to the right to reduce the size of the entry area 63 and secure the over flap 61 to the under flap 62. The hand of a user must be compressed as shown in FIG. 10 to enter this glove.

FIG. 19 Shown in bottom view is a typical fighting glove 64, having a pull over flap 65 with a hook and loop material, an under flap 66 with a hook and loop material, and an open area 67. This glove offers no way to stop the under flap 66 from moving to the right as the over flap 65 is pulled to the right to reduce the size of the entry area and secure the over flap 65 to the under flap 66. Even with the large open area 67 because it is configured in the middle of the palm the hand of a user must be compressed as shown in FIG. 10 to enter this glove.

FIG. 20 Shown in top view is a typical winter glove 68, having an elastic stretchable area 69 at the entry end at the wrist area.

This glove offers no way to reduce the size of the entry area beyond the default length of the installed elastic banding in the stretchable area 69. The hand of a user must be compressed as shown in FIG. 10 to enter this glove.

FIG. 21 Shown in top view is a typical driving glove. This glove offers no way to stop the under flap 72 from moving to the left as the over flap 71 is pulled to the left to reduce the size of the entry area and secure the over flap 71 to the under flap 72. The hand of a user must be compressed as shown in FIG. 10 to enter this glove.

Figure 22:
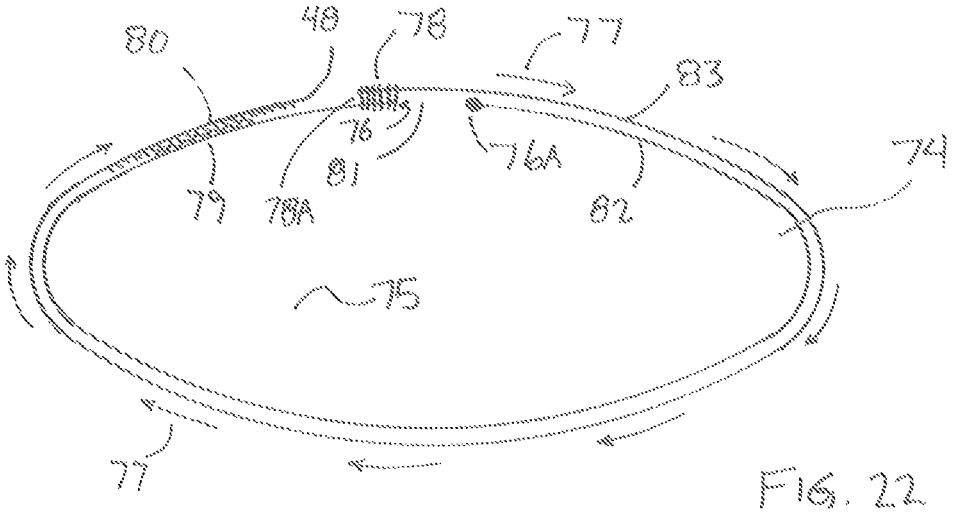
FIG. 22 Showing entry end of a glove detailing a securement strap securing the glove entry end.

FIG. 22 Showing the entry end 75 of a typical glove 74 detailing a securement strap 83. The securement strap 83 having a permanent connection end 78 and a releaseable secureable end 48.

The permanent connection end 78 of the securement strap 83 permanently attached at the securement strap connection point 78A. The releaseable secureable end 48 of the securement strap 83 having a patch of male hook and loop material 80 for secure engagement with a female patch of hook and loop material 79 permanently attached to the glove. The entry end 75 having an additional opening area 81 being shown between the left edge 76 of the additional opening 81 and the right edge 76A of the additional opening 81.

This glove offers no ability to close the space between the additional opening edge 76 and the additional opening edge 76A, when pulling the securement strap 83 in the direction of arrows 77 it effectively pulls the entire glove around the wrist of the user. The strap pulls on the securement strap connection point 78A which pulls the glove material in the direction of the arrows 77, pulling 76 clockwise pulls the entirety of the glove clockwise all the way around the material the end 76A, therefore the additional opening 81 space never reduces in size. This functions much like a belt that does not pass through a buckle to leverage against the opposite direction to affect a tightening of the belt around the user.

Figure 23:
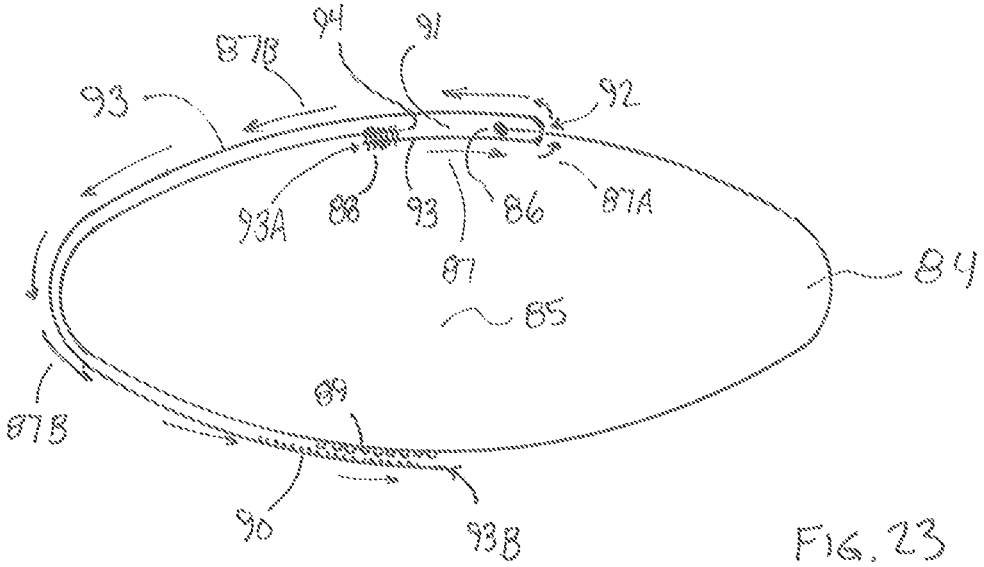
FIG. 23 Showing entry end of current invention detailing the securement strap securing the glove entry end.

FIG. 23 Showing entry end 85 of current glove invention 84 detailing the securement strap 93. The securement strap 93 having a permanent connection end 93A and a releaseable secureable end 93B.

The permanent connection end 93A of the securement strap 93 permanently attached at the securement strap connection point 88. The releaseable secureable end 93B of the securement strap 93 having a patch of male hook and loop material 90 for secure engagement with a female patch of hook and loop material 89 permanently attached to the glove. The entry end 85 having an additional opening area 91 (see FIG. 8 for a different view angle) being shown between the left edge of the additional opening 94 and the right edge of the additional opening 86.

The securement strap 93 from the connection point 88 following the direction of arrow 87 and then arrow 87A showing the securement strap 93 then passing through the securement strap slot 92. The securement strap 93 then reversing direction as indicated by arrow 87B, this direction change pulls the left edge 94 and the right edge 86 of the additional opening 91 together and tightening the entry end 85 of the glove around the wrist of the user followed by the hook and loop material on the glove 89 and the hook and loop material on the securement strap 90 engaging and securing the tightened entry end reduced size position.

The securement strap starting on the left side edge 94 of the additional opening 91 and then passing through the right side edge 86 of the additional opening 91 pulls the left side towards the right side, the securement strap 93 is then pulled back towards the left edge 94 of the additional opening 91 moving both the left edge 94 and the right edge 86 of the additional opening 91 towards each other reducing the size of the entry opening 85.

This method of securement keeps the glove from being pulled around the wrist when trying to secure the glove on the wrist of a user with the securement strap 93 by controlling the entirety of the glove, something no other glove has the features to perform.

Figure 24:
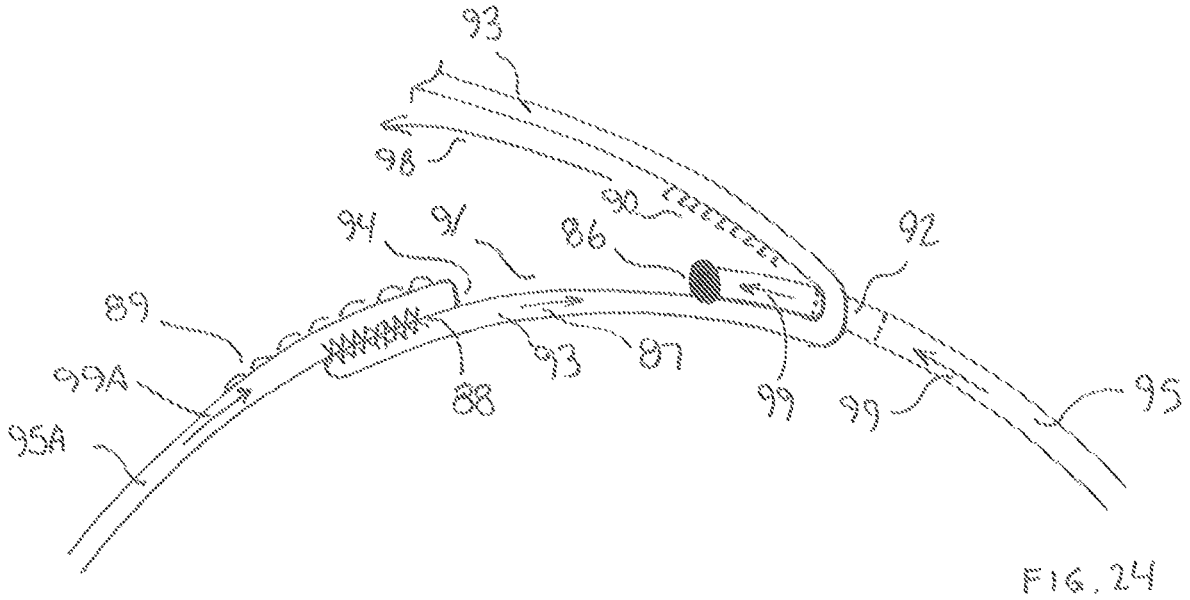
FIG. 24 Showing a close up view of FIG. 23 detailing the securement strap affecting the glove entry.

FIG. 24 Showing a close up view of FIG. 23 detailing the how the securement strap 93 affects the additional opening area 91 of the glove entry end 85. The feature is detailed prior to the securement strap 93 being pulled to reduce the internal size of the entry opening 85.

By pulling securement strap 93 the direction of arrow 98 the securement strap will pull glove material 95A on the left side 94 of the additional opening 91 in the direction of arrow 99A, as the securement strap 93 passes through the securement strap slot 92 positioned on the right side 86 of the additional opening 91 in glove material 95, the securement strap pulls glove material 95 in the direction of arrow 99. The securement strap 93 controls both sides of the additional opening 91, similar to how a belt around a waist works, further detailed in below.

Figure 25:
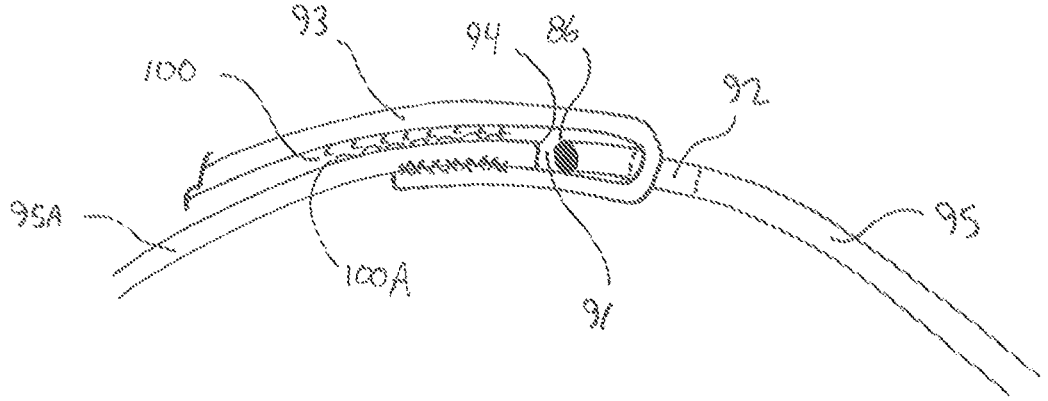
FIG. 25 Showing a close up view of FIG. 23 detailing the securement strap affecting the glove entry.

FIG. 25 Showing a close up view of FIG. 23 detailing the securement strap 93 after being pulled and secured. The additional opening 91 is considerably smaller than in FIG. 24 with the left side 94 of the additional opening 91 almost touching the right side 86 of the additional opening 91.

The securement strap 93 being shown shorter in length in this figure than in FIG. 23 due to increased size of the drawing while still wanting to show all the features.

The male portion of the hook and loop material 100 attached to the securement strap 93 is engaged with the female portion of the hook and loop material 100A which is attached to the glove material 95A. Important to note that this tightening feature occurs prior to the securement strap being secured with the hook and loop material engagement.

This method of tightening function is similar to pulling a belt tight, the belt itself passes through the buckle (just as the securement strap 93 passes through the securement strap slot 92), the belt is then pulled back over itself to achieve a tight fit around the user, this works because passing through the buckle and then changing direction of the pull allows both ends of the belt to be controlled, after a tight fit is achieved the belt is pinned for securement and then the excess is fed through the buckle again. The pin of the belt secures the achieved tight fit similar to how the hook and loop material secures the tight fit after the securement strap has been pulled. Bringing glove material 95A and 95 together at the additional opening 91.

Typical gloves do not have the ability to bring the two sides of their opening together, therefore the securement strap of a typical glove is chasing the glove itself around the wrist (see and read FIG. 22) and eventually catches the other side of the glove and the hook and loop finds itself while the glove remains somewhat loose.

Due to this inability to tighten a glove entry end, gloves are then wrapped with tape around the entry end at the wrist of the user.

Figure 26:
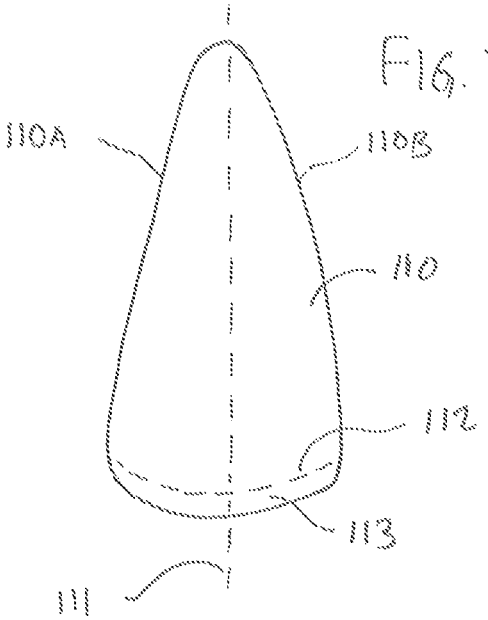
FIG. 26 Showing a top view of a finger sheath to finger sheath filler panel.

FIG. 26 Shown in top view is a finger sheath to finger sheath filler flap 110 similar in shape to an A-frame house. The left edge 110A and the right edge 110B are also shown. Dotted line 111 details where the main fold of the material will occur when positioned into a scoop shape. Dotted line 112 details a fold line to delineate the attachment fold flap 113 portion of the filler flap 110.

Figure 27:
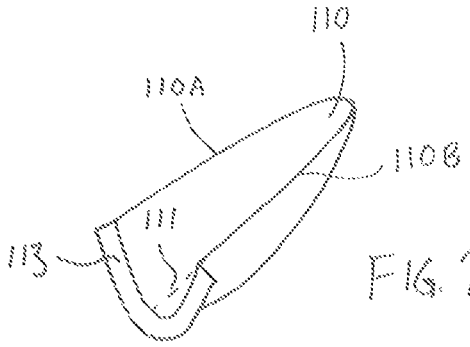
FIG. 27 Showing a /3;4 front view of a finger sheath to finger sheath filler flap with bent mounting edge material.

FIG. 27 Shown in ¾ front top view detailing the finger sheath to finger sheath filler flap 110 positioned into a scoop shape required for installing into the glove. The attachment fold flap 113 is clearly defined and is designed to be attached to the surface of the palm portion 10 of the glove.

Figure 28:
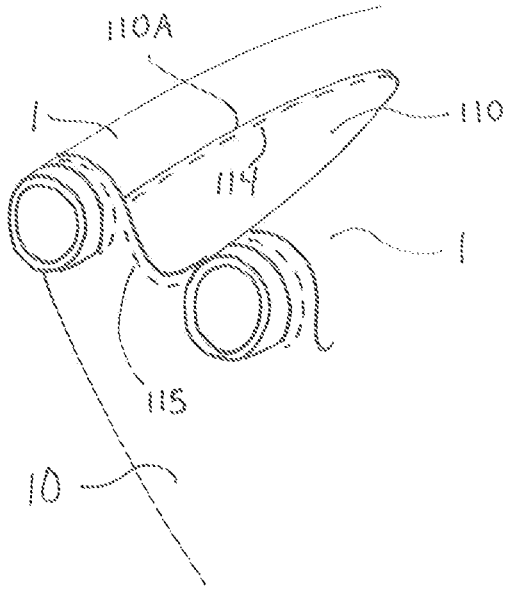
FIG. 28 Showing a /3;4 front view of a finger sheath to finger sheath filler flap positioned between two finger sheaths for example.

FIG. 28 Shown in 34 front top view and (showing only two finger sheaths for example) detailing the finger sheath to finger sheath filler flap 110 in assembled position between two finger sheaths 1 and attached to the side of each finger sheath 1 shown with stitching 114.

The attachment fold flap 113 of the finger sheath to finger sheath filler flap 110 (as shown in FIG. 27) is attached to the surface of the palm portion 10 with stitches 115. (The additional stitches shown around the finger sheaths are best detailed in FIG. 5 as 17B2)

The finger sheath to finger sheath filler flap 110 removes the ability for an opponent to grab the user's fingers in a fight, this not only removes a potential advantage from the opponent it also removes potential injury that can easily occur when a finger is grabbed and then jammed or twisted injuring a knuckle/joint. The finger sheath to finger sheath filler flap connection to the finger sheaths, in addition to the palm portion connection to the finger sheaths, do not diminish independent finger sheath 1 dexterity.

Figure 29:
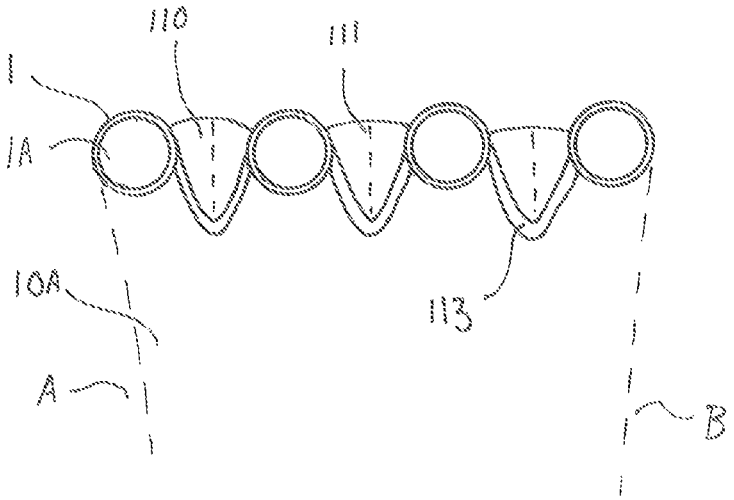
FIG. 29 Showing a front view of a plurality of finger sheath ends and a multitude of finger sheath to finger sheath filler flaps positioned between the aforementioned finger sheaths.

FIG. 29 Shown in front view and detailing the fingertip ends 1A of the finger sheaths 1. The palm portion 10 is shown as a "ghost" 10A by dotted lines A and B to give reference of the environment the finger sheath to finger sheath filler flaps 110 exist within. One finger sheath to finger sheath filler flap 110 is detailed between each of the four finger sheaths, with the dotted centerline 111 included for consistent reference across FIGS. 26-29. The attachment fold flap 113 is also clearly detailed.

Throughout this description, the embodiments and examples shown should be considered as exemplars, rather than limitations on the apparatus, procedures, and methods disclosed or claimed.

Although many of the examples presented herein involve specific combinations of method acts or system elements, it should be understood that those acts and those elements may be combined in other ways to accomplish the same objectives.

Acts, elements and features discussed only in connection with one embodiment are not intended to be excluded from a similar role in other embodiments.

The invention claimed is:

1. A method for constructing a glove in which a plurality of finger sheaths are retained in an arced position and restricted from extending into a straightened position;

the glove consisting of an entry end, a back portion with a back portion entry end and a finger sheath connection end, a palm portion with a palm portion entry end and a finger sheath fingertip connection end, a plurality of arced finger sheaths each having a connection end and a fingertip end, a thumb sheath with a connection end and a thumb tip end, a plurality of finger sheath-to-finger sheath filler flaps, a plurality of arced finger sheath knuckle paddings, an arced back portion knuckle padding, an expandable side entry, and a securement strap; the method steps of construction comprising:

A) attaching the back portion to the palm portion,

B) constructing the plurality of finger sheaths such that they each have an arced position and no ability to straighten, the arced position of the finger sheaths being similar to a natural resting position of a finger, thereby removing the tension found with typical gloves that are constructed flat and straight and then bent into an arc when used, C) attaching the plurality of finger sheaths to the back portion;

D) creating a plurality of holes in the fingertip end of the palm portion of the glove, respectively receiving the fingertip end of each of the finger sheaths;

E) placing the fingertip end of each finger sheath through one of the plurality of holes in the fingertip end of the palm portion of the glove, F) attaching the fingertip end of each finger sheath to one of the plurality of holes in the fingertip end of the palm portion of the glove, thereby retaining each finger sheath in its arced position, G) attaching a respective one of the plurality of finger sheath-to-finger sheath filler flaps between respective adjacent finger sheaths, H) attaching the connection end of the thumb sheath to a hole in the palm portion, I) attaching a respective one of said plurality of arced finger sheath knuckle paddings to each finger sheath; and J) attaching the arced back portion knuckle padding to the back portion in a location adapted to overlie the metacarpophalangeal joint of a user's hand when worn.

2. The method for constructing a glove as claimed in claim 1, wherein constructing each of the plurality of finger sheaths comprises the following:

A) sewing together material to form a tube-shaped finger sheath with a through hole configured to fully encircle a finger;

B) pressing the sewn finger sheath flat on a flat surface, orienting a length of the tube-shaped finger sheath in a linear, horizontal direction;

C) removing an inverted "V" shaped section of the material from a middle position of the finger sheath, where an open end of the inverted "V" is located at a bottom edge of the tube-shaped finger sheath and a closed end of the inverted "V" ending short of an upper edge of the tube-shaped finger sheath;

D) then manipulating the tube-shaped finger sheath into an arced shape until sides of the inverted "V" come together; and E) attaching said sides to one another, thereby removing the ability for the finger sheath to extend to a straightened position.

3. The method for constructing a glove as claimed in claim 1, wherein;

said step of attaching the connection end of each finger sheath to the fingertip connection end of the palm portion of the glove, placing the fingertip end of each finger sheath through one of the plurality of holes in the fingertip connection end of the palm portion of the glove, additionally comprising folding material of the finger sheath fingertip connection end of the palm portion located on a far side of each hole from said entry end of said palm portion around an outside of the fingertip end of the respective finger sheath that is received therethrough and attaching said material to said fingertip end of the finger sheath, whereby the attachment of the palm portion around the finger sheath provides additional restrictive securement of the finger sheath in the arced position, in the event the user attempts to straighten a finger.

4. The method for constructing a glove as claimed in claim 1 further comprising:

A) attaching the securement strap to the palm portion of the glove;

B) providing the back portion with a securement strap slot;

C) providing said securement strap with one of a hook fastener patch and a loop fastener patch;

D) providing said palm portion with the other of the hook fastener patch and loop fastener patch; whereby after donning the glove, a user can pass the securement strap through the securement strap slot and secure said hook fastener patch attached to the securement strap to said loop fastener patch attached to the palm portion to hold said expandable side entry in a closed position.

5. The method for constructing a glove as claimed in claim 1 further comprising the following steps to build each of said plurality of arced finger sheath knuckle paddings:

A) cutting a plurality of elongated strips of a knuckle padding;

B) placing each strip of knuckle padding flat on a surface and orientating a length of the strip in a linear, horizontal direction;

C) making a plurality of cuts in the knuckle padding from an upper edge thereof, the cuts extending toward a lower edge of the knuckle padding so as to penetrate at least half of a width of the knuckle padding, D) bending said strip of knuckle padding into an arced shape until sides of said cuts separate to form a plurality of "V" shaped cut spaces; and E) inserting a small piece of padding into each of the open "V" shaped cut spaces to maintain the arced shape in the finger sheath knuckle padding as a natural default shape.

6. The method for constructing a glove as claimed in claim 1 further comprising the following steps to build said arced back portion knuckle padding:

A) cutting an elongate strip of padding,

B) placing the elongate strip of padding flat on a surface and orientating a length of the strip in a linear, horizontal direction;

C) making a plurality of cuts in a top edge of the elongate strip of padding, the cuts extending toward a lower edge of the knuckle padding so as to penetrate at least half of a width of the knuckle padding;

D) bending the elongate strip of padding into an arced shape until sides of said cuts separate to form a plurality of "V" shaped cut spaces;

E) inserting a small piece of padding into each of the open "V" shaped cut spaces to maintain the arced shape in the elongate strip of padding as a natural default shape.

7. The method for constructing a glove as claimed in claim 1 further comprising the following steps to build each of the plurality of finger sheath-to-finger sheath filler flaps:

A) providing a substantially triangular shape of filler flap material having two longer sides and a shorter bottom side, the substantially triangular shape having an attachment fold flap extending along the shorter bottom side;

B) manipulating the filler flap material into a scoop shape;

C) bending the attachment fold flap 90 degrees relative to the scoop shape;

D) then inserting the filler flap material between two adjacent finger sheaths and attaching one longer side of the filler flap to a side of one of said adjacent finger sheaths and attaching the other longer side of the filler flap to a side of the other adjacent finger sheath; and E) attaching the filler flap attachment fold flap to the palm portion.

* * * * *